United States Patent [19]

La Bate, II et al.

[11] Patent Number: 4,637,592

[45] Date of Patent: Jan. 20, 1987

[54] ELEVATED SWINGING DEVICE FOR PLACING SLAG RETENTION DEVICES IN TAPPING CONVERTERS

[75] Inventors: Michael D. La Bate, II, Ellwood City; Joseph A. Perri, Coraopolis, both of Pa.

[73] Assignee: Insul Company, Inc., East Palestine, Ohio

[21] Appl. No.: 747,799

[22] Filed: Jun. 24, 1985

Related U.S. Application Data

[63] Continuation-in-part of Ser. No. 643,499, Aug. 23, 1984, Pat. No. 4,553,743.

[51] Int. Cl.[4] ..... C21B 5/46

[52] U.S. Cl. ..... 266/272

[58] Field of Search ..... 266/236, 271, 272; 222/597; 137/172

[56] References Cited

U.S. PATENT DOCUMENTS

| | | | |
|---|---|---|---|
| 1,661,745 | 3/1928 | Brosius | 266/272 |
| 1,835,838 | 12/1931 | Anderson, Jr. | 266/272 |
| 3,459,209 | 8/1967 | Kobush et al. | 137/172 |
| 4,431,169 | 2/1984 | Fuzii et al. | 266/236 |

FOREIGN PATENT DOCUMENTS

| | | | |
|---|---|---|---|
| 0993365 | 5/1965 | United Kingdom | 266/271 |

*Primary Examiner*—L. Dewayne Rutledge
*Assistant Examiner*—S. Kastler
*Attorney, Agent, or Firm*—Harpman & Harpman

[57] ABSTRACT

A swinging device pivotally suspended from an overhead support adjacent a tapping converter telescopically positions a boom for relative vertical tilting and swinging motion toward and away from said converter on an arcuate path on a vertical plane. The boom supports a boom extension and jaws on the boom extension releaseably hold a slag retaining device so that the same can be moved into the converter and positioned in the tap hole thereof.

3 Claims, 1 Drawing Figure

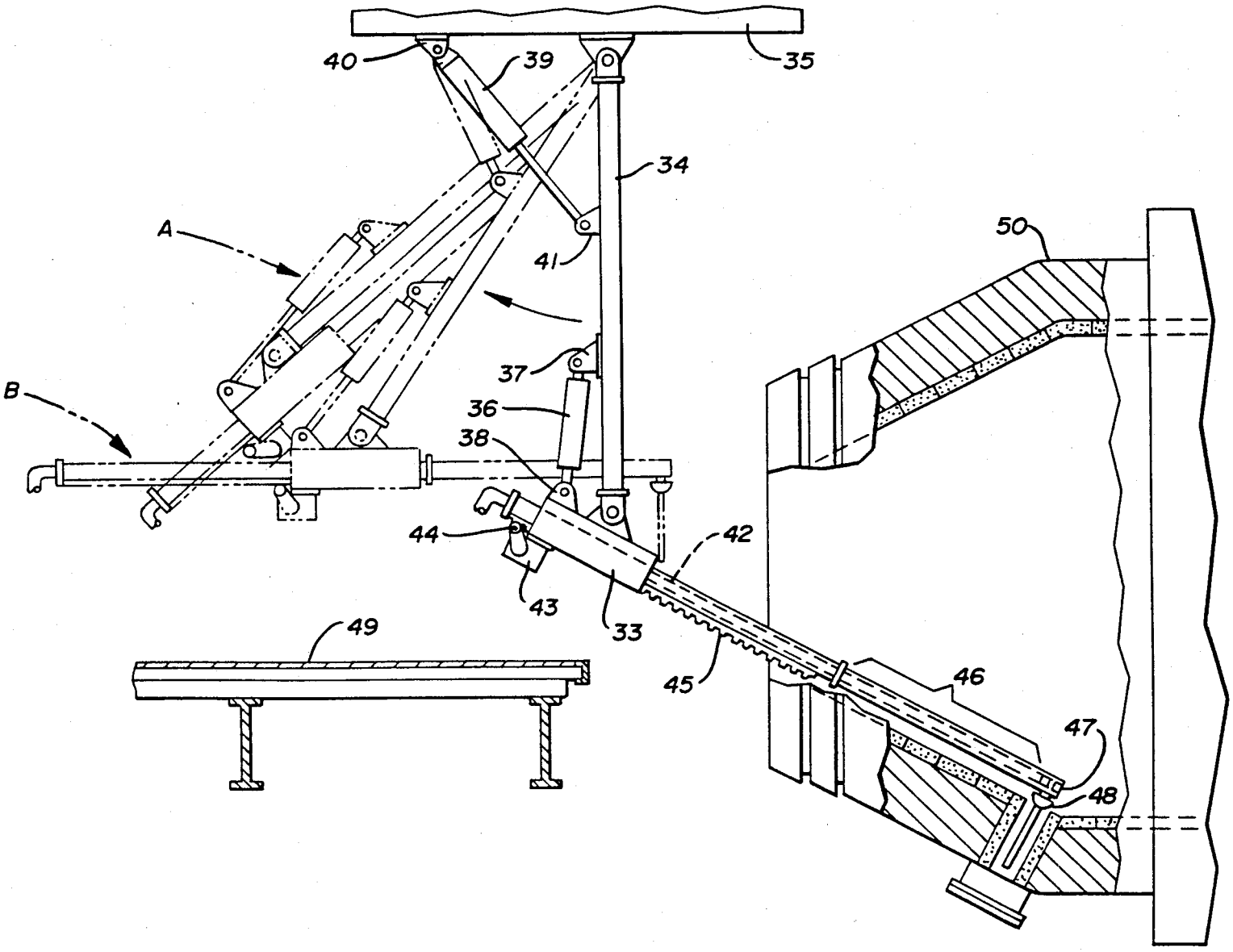
35
34
39
40
41
37
36
38
44
43
33
42
45
46
47
48
50
49
A
B

ELEVATED SWINGING DEVICE FOR PLACING SLAG RETENTION DEVICES IN TAPPING CONVERTERS

This is a continuation-in-part of application Ser. No. 06/643,499 filed 8/23/84, now U.S. Pat. No. 4,553,743.

BACKGROUND OF THE INVENTION

1. Technical Field

This invention relates to an elevated device for accurately and forcibly positioning a slag retaining closure or dart in a tapping converter during the tapping of steel therefrom.

2. Description of the Prior Art

Prior structures of this type are best represented by the disclosures of U.S. Pat. Nos. 3,459,209 and 4,431,169 in which closures are positioned in converters by arms adjustably and movably mounted adjacent the converters and which releaseably hold the closures.

SUMMARY OF THE INVENTION

The presesnt invention utilizes a two-part extensible boom similar to the arms of the prior art patents and provides a swingable device pivoted to an overhead support for telescopically holding the boom and means for moving the device in an arcuate path on a vertical plane and in tilting relation to the overhead support. The device enables the operator to easily and quickly position a slag retaining closure or dart in the tap hole of the converter where it prevents slag on the top of the molten steel from entering the tap hole when the steel has substantially drained therethrough.

DESCRIPTION OF THE DRAWINGS

The drawing FIGURE is a side elevation of the elevated swinging device for placing slag retention devices in tapping converters, a portion of an operating floor therebelow and a portion of a converter with parts broken away and parts in cross section.

DESCRIPTION OF THE PREFERRED EMBODIMENT

By referring to the FIGURE of the drawings, the invention can be seen wherein a tubular device 33 is pivotally secured to the lower end of a swingable support member 34 that is pivotally secured at its upper end to a suitable overhead structure 35 adjacent a tapping converter 50 and above an operating floor 49. A piston and cylinder assembly 36 is pivotally attached by a pivot bracket 37 to the swingable support member 34 and to the tubular device 33 by a pivot bracket 38 so that actuation of the piston and cylinder assembly 36 as from a remote control point will tilt the tubular device 33 relative to the lower end of the swingable support member 34.

A secondary piston and cylinder assembly 39 is pivotally attached to a pivot bracket 40 on the overhead structure 35 and to a pivot bracket 41 on the swingable support member 34 so that the swingable support member 34 is movable in an arcuate path on a vertical plane toward and away from the converter 50 from the position shown in solid lines in the drawing to the alternate positions shown in broken lines in the drawing.

A boom 42 extends through and is held by the tubular device 33 on the lower end of the swingable support member 34 and an air motor drive mechanism 43 is positioned on one end of the tubular device 33 and arranged to drive a pinion gear 44 which is engaged on a gear rack 45 secured to the lower portion of the boom 42. A replaceable boom portion 46 has jaws 47 in the outermost end thereof which are actuated by a device for imparting movement thereto, which device is mounted in the tubular device 33 and remotely controlled.

The jaws 47 are adapted to releaseably engage a slag retaining closure or dart 48.

In operation, the support member 34 can be moved in a swinging motion in an arcuate path based on a pivotal attachment to the overhead structure 35 so that the tubular device 33 moves toward and away from the converter 50 and to an elevated position substantially above the operating floor 49 in front of the converter 50. It will be seen that the boom 42 can be extended and retracted relative to the tubular device 33 and the swingable support member 34 by rotation of the pinion gear 44 relative to the rack 45. The swingable support member 34 is moved by the secondary piston and cylinder assembly 39 and the tubular device 33 moved by the piston and cylinder assembly 36 from the position shown in unbroken lines in the drawing to the optional position shown in broken lines in the drawing.

It will thus be seen that movement of the several parts of the apparatus will position the tubular device 33 and the boom 42 in position A shown in broken lines well above the operating floor 49 opposite the converter 50 so that it will not interfere with the operator's activities on the operating floor 49.

It will be appreciated that the device of the invention is important to the steel making industry in supplying the demand for slag-free steel which necessitates blocking the flow of slag from a steel producing furnace or converter when most of the molten steel has been removed and the layer of slag which normally floats on the steel is approaching the tap hole.

Having thus described our invention, what we claim is:

1. Apparatus for placing a slag retaining device in a tap hole in a converter comprising a two-part boom extensible into said converter, a swingable support member pivotally attached at a top end thereof to and suspended from an overhead support structure, extensible means attached at one end to said overhead support structure and at another end to said swingable support member at a location spaced from said swingable support member top end for moving said swingable support member, in a vertical plane on a first arcuate path based on said pivotal attachment to said overhead support structure from a first vertical position adjacent said converter to a second angular position away from said converter, a tubular device pivotally positioned on a lower end of said swingable support member, one part of said two-part boom being positioned in said tubular device, means on said tubular device for moving said one part of said boom telescopically with respect to said tubular device, extendable means having one end attached to said swingable support member and another end attached to said tubular device for moving said tubular device in a second arcuate path in said vertical plane based on said pivotal attachment of said tubular device to said swingable support member, means on one end of the other part of said two-part boom for detachably engaging said slag retaining device, said slag retaining device moving in said vertical plane and remaining in said vertical plane during storage whereby said slag retaining device can be oriented to be aligned with the converter tap hole and moved into and out of a tap hole plugging position without disturbing that alignment and can be in a stored condition above an operating floor while remaining aligned with the tap hole.

2. The apparatus for placing a slag retaining device in a tap hole in a converter set forth in claim 1 and wherein said means on said swingable support member for moving said tubular device comprises a piston and cylinder assembly and remote means for powering and controlling the same.

3. The apparatus for placing a slag retaining device in a tap hole in a converter set forth in claim 1 and wherein said extensible means on said overhead support structure for swinging the swingable support member toward and away from said converter comprises a piston and cylinder assembly and remote means for powering and controlling the same.

* * * * *